US012797767B2

(12) United States Patent
Zhou

(10) Patent No.: US 12,797,767 B2
(45) Date of Patent: Nov. 17, 2026

(54) WEARABLE INFLATABLE COSTUME

(71) Applicant: Shenzhen Xinbenchuang Electronics Co., Ltd., Shenzhen (CN)

(72) Inventor: Zanzan Zhou, Shenzhen City (CN)

( * ) Notice: Subject to any disclaimer, the term of this patent is extended or adjusted under 35 U.S.C. 154(b) by 197 days.

(21) Appl. No.: 18/761,600

(22) Filed: Jul. 2, 2024

(65) Prior Publication Data

US 2025/0387724 A1 Dec. 25, 2025

(30) Foreign Application Priority Data

Jun. 21, 2024 (CN) ..... 202421437077.0

(51) Int. Cl.
*A63J 7/00* (2006.01)

(52) U.S. Cl.
CPC ..... *A63J 7/005* (2013.01)

(58) Field of Classification Search
CPC .... A63H 3/06; A63J 7/00; A63J 7/005; A41D 1/00
USPC ..... 446/26, 28; D2/741
See application file for complete search history.

(56) References Cited

U.S. PATENT DOCUMENTS 2,810,576 A * 10/1957 Massey ..... A41D 11/00 2/265
4,770,408 A * 9/1988 Wolfe ..... A63G 17/00 446/28
5,048,123 A * 9/1991 Monson ..... A41D 27/08 446/28
5,218,721 A * 6/1993 Mathews ..... A41B 13/103 2/244
6,536,049 B2 * 3/2003 Jastrab ..... A41D 1/00 446/26
7,037,163 B2 * 5/2006 Beard ..... A63H 33/00 446/28
8,087,969 B2 * 1/2012 Sun ..... A63J 7/005 446/28
10,477,906 B2 * 11/2019 Mangnall-Schwarz ..... A41D 27/10
10,751,637 B1 * 8/2020 Kelly ..... F21V 23/04
11,690,420 B1 * 7/2023 Shaffa ..... A41G 11/00 446/84
2015/0264986 A1 * 9/2015 Coleman ..... A45F 3/042 362/156
2018/0174499 A1 * 6/2018 De Grasse ..... A63H 3/06
(Continued)

FOREIGN PATENT DOCUMENTS

ES 1079505 U * 5/2013 ..... A63J 7/00

*Primary Examiner* — Kurt Fernstrom
(74) *Attorney, Agent, or Firm* — SciNova; Jingfeng Song

(57) ABSTRACT

A wearable inflatable costume includes an inflatable costume main body and a strap assembly. The inflatable costume main body is provided with a plurality of side walls and an inflation chamber. The inflation chamber is formed by encircling the plurality of side walls of the inflatable costume main body. The strap assembly is connected to the inflatable costume main body, and a wearing space is formed by being surrounded between the strap assembly and the inflatable costume main body. A user can wear the inflatable consume main body through the wearing space formed between the strap assembly and the inflatable costume main body and can carry the inflatable costume main body on the shoulders. Compared with an ordinary inflatable costume that cannot be worn by a user only when the user enters the inflatable costume, the wearable inflatable costume is not sweltering and has high wearing comfort.

18 Claims, 10 Drawing Sheets

(56) References Cited

U.S. PATENT DOCUMENTS

| | | | | |
|---|---|---|---|---|
| 2021/0030142 | A1* | 2/2021 | Starkey | A63H 3/20 |
| 2023/0381678 | A1* | 11/2023 | Gu | A63H 3/36 |

* cited by examiner

WEARABLE INFLATABLE COSTUME

CROSS-REFERENCE TO RELATED APPLICATIONS

The application claims priority of Chinese patent application 2024214370770, filed on Jun. 21, 2024, which is incorporated herein by reference in its entireties.

TECHNICAL FIELD

The present disclosure relates to the field of inflatable costumes, and in particular, to a wearable inflatable costume.

BACKGROUND

In today's entertainment culture, the rise of festival celebrations and theme activities provides a unique stage for the application of inflatable doll costumes. For example, Halloween attracts thousands of children and adults to participate in the celebration in various creative looks. In this happy festival, inflatable doll costumes have become one of the favorite outfits for children due to their exaggerated and funny appearances. However, the existing inflatable costumes are inconvenient to wear. Furthermore, when wearing the inflatable costume, a wearer feels sweltering. Therefore, there is an urgent need to provide a wearable inflatable costume that is convenient to wear and makes a user feel comfortable when the user wears the costume, to improve the user experience.

SUMMARY

In order to overcome the shortcomings of the prior art, the present disclosure provides a wearable inflatable costume.

The wearable inflatable costume, includes:

an inflatable costume main body, wherein the inflatable costume main body is provided with a plurality of side walls and an inflation chamber, and the inflation chamber is formed by encircling the plurality of side walls of the inflatable costume main body; and a strap assembly, wherein the strap assembly is connected to the inflatable costume main body, and a wearing space is formed by being surrounded between the strap assembly and the inflatable costume main body.

As an improvement of the present disclosure, the strap assembly includes a first strap; the first strap has a first end and a second end; the first end of the first strap is connected to an upper side of the inflatable costume main body; the second end of the first strap is connected to a lower side of the inflatable costume main body; and the wearing space is formed between the first strap and the inflatable costume main body.

As an improvement of the present disclosure, the wearable inflatable costume further includes a first adjustment buckle, wherein the first adjustment buckle is connected to the first strap; and the first adjustment buckle is configured to adjust a length of the first strap to adjust a size of the wearing space.

As an improvement of the present disclosure, the strap assembly further includes a second strap; the second strap has a third end and a fourth end; the third end of the second strap is connected to an upper side of the inflatable costume main body; the fourth end of the first strap is connected to a lower side of the inflatable costume main body; and the wearing space is formed between the second strap and the inflatable costume main body.

As an improvement of the present disclosure, the wearable inflatable costume further includes a second adjustment buckle, wherein the second adjustment buckle is connected to the second strap; and the second adjustment buckle is configured to adjust a length of the second strap to adjust a size of the wearing space.

As an improvement of the present disclosure, the strap assembly is an elastic strap assembly.

As an improvement of the present disclosure, the wearable inflatable costume further includes a shaping portion, wherein two ends of the shaping portion are separately connected to two side walls among the plurality of side walls; and the shaping portion is configured to fix a spacing between the two side walls among the plurality of side walls.

As an improvement of the present disclosure, the inflatable costume main body at least includes an upper side wall, a lower side wall, and a connecting side wall for connecting the upper side wall to the lower side wall; one end of the shaping portion is connected to the upper side wall, and the other end of the shaping portion is connected to the lower side wall; and the shaping portion is configured to fix a spacing between the upper side wall and the lower side wall.

As an improvement of the present disclosure, the shaping portion is arranged in the inflation chamber; one end of the shaping portion is connected to an inner surface of the upper side wall; and the other end of the shaping portion is connected to an inner surface of the lower side wall.

As an improvement of the present disclosure, the shaping portion includes a plurality of elongated shaping fabrics spaced apart from each other.

As an improvement of the present disclosure, the wearable inflatable costume further includes a light string, wherein the light string is arranged in the inflation chamber.

As an improvement of the present disclosure, the wearable inflatable costume further includes a binding belt, wherein the binding belt is connected to the inflatable costume main body; the binding belt is located in the inflation chamber; and the light string is connected to the inflatable costume main body through the binding belt.

As an improvement of the present disclosure, the wearable inflatable costume further includes a light string and a binding belt, wherein the binding belt is connected to the inflatable costume main body; and the light string is connected to the inflatable costume main body through the binding belt.

As an improvement of the present disclosure, the first strap includes a first strap unit and a second strap unit; the first end is arranged at the first strap unit; the second end is arranged at the second strap unit; the first strap unit further has a fifth end opposite to the first end; the second strap unit further has a sixth end opposite to the second end; the first end of the first strap unit is connected to the upper side of the inflatable costume main body; the second end of the second strap unit is connected to the lower side of the inflatable costume main body; and the fifth end of the first strap unit is connected to the sixth end of the second strap unit through a first adjustment buckle.

As an improvement of the present disclosure, the first adjustment buckle is provided with a first main body and a first division portion; the first main body has a first upper surface, a first lower surface, and a first opening; the first division portion is connected to the first main body; the first division portion is configured to divide the first opening into a first adjustment hole and a second adjustment hole; the sixth end is connected to the first division portion; and the fifth end penetrates into the first upper surface through the first adjustment hole on the first lower surface of the first main body, and penetrates into the first lower surface through the second adjustment hole on the first upper surface, so that the fifth end of the first strap unit slides through the first division portion in the first adjustment hole and the second adjustment hole to adjust a distance between the first adjustment buckle and the first end, so as to adjust the size of the wearing space.

As an improvement of the present disclosure, the second strap includes a third strap unit and a fourth strap unit; the third end is arranged at the third strap unit; the fourth end is arranged at the fourth strap unit; the third strap unit further has a seventh end opposite to the third end; the fourth strap unit further has an eighth end opposite to the fourth end; the third end of the third strap unit is connected to the upper side of the second inflatable costume main body; the fourth end of the fourth strap unit is connected to the lower side of the inflatable costume main body; and the seventh end of the third strap unit is connected to the eighth end of the fourth strap unit through a second adjustment buckle.

As an improvement of the present disclosure, the second adjustment buckle is provided with a second main body and a second division portion; the second main body has a second upper surface, a second lower surface, and a second opening; the second division portion is connected to the second main body; the second division portion is configured to divide the second opening into a third adjustment hole and a fourth adjustment hole; the eighth end is connected to the second division portion; and the seventh end penetrates into the second upper surface through the third adjustment hole on the second lower surface of the second main body, and penetrates into the second lower surface through the fourth adjustment hole on the second upper surface, so that the seventh end of the third strap unit slides through the second division portion in the third adjustment hole and the fourth adjustment hole to adjust a distance between the second adjustment buckle and the third end, so as to adjust the size of the wearing space.

As an improvement of the present disclosure, the fifth end of the first strap unit is detachably connected to the sixth end of the second strap unit through the first adjustment buckle; and the seventh end of the third strap unit is detachably connected to the eighth end of the fourth strap unit through the second adjustment buckle.

As an improvement of the present disclosure, the inflatable costume main body is a human-shaped or animal-shaped inflatable costume main body or a plant-shaped inflatable costume main body.

As an improvement of the present disclosure, the inflatable costume main body is a polyester fiber inflatable costume main body.

As an improvement of the present disclosure, the inflatable costume main body is a butterfly-shaped inflatable costume main body.

As an improvement of the present disclosure, the wearable inflatable costume further includes an air pump; the inflatable costume main body is provided with a opening and an inflation port; the opening is communicated to the inflation chamber; a zipper is arranged at the opening; the zipper is configured to open or close the opening; the air pump is arranged in the inflation chamber; and the air pump is arranged at the inflation port to inflate the inflation chamber. The air pump is provided with a switch and a battery. The switch is configured to switch on or switch off the air pump.

The present disclosure has the beneficial effects: The present disclosure provides a wearable inflatable costume. Since the wearable inflatable costume includes: a inflatable costume main body, wherein the inflatable costume main body is provided with a plurality of side walls and an inflation chamber, and the inflation chamber is formed by encircling the plurality of side walls of the inflatable costume main body; and a strap assembly, wherein the strap assembly is connected to the inflatable costume main body, and a wearing space is formed by being surrounded between the strap assembly and the inflatable costume main body. A user can wear the inflatable consume main body through the wearing space formed between the strap assembly and the inflatable costume main body and can carry the inflatable costume main body on the shoulders. Compared with an ordinary inflatable costume that cannot be worn by a user only when the user enters the inflatable costume, the wearable inflatable costume is not sweltering and has high wearing comfort, and a user can wear the inflatable costume main body for a long time.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
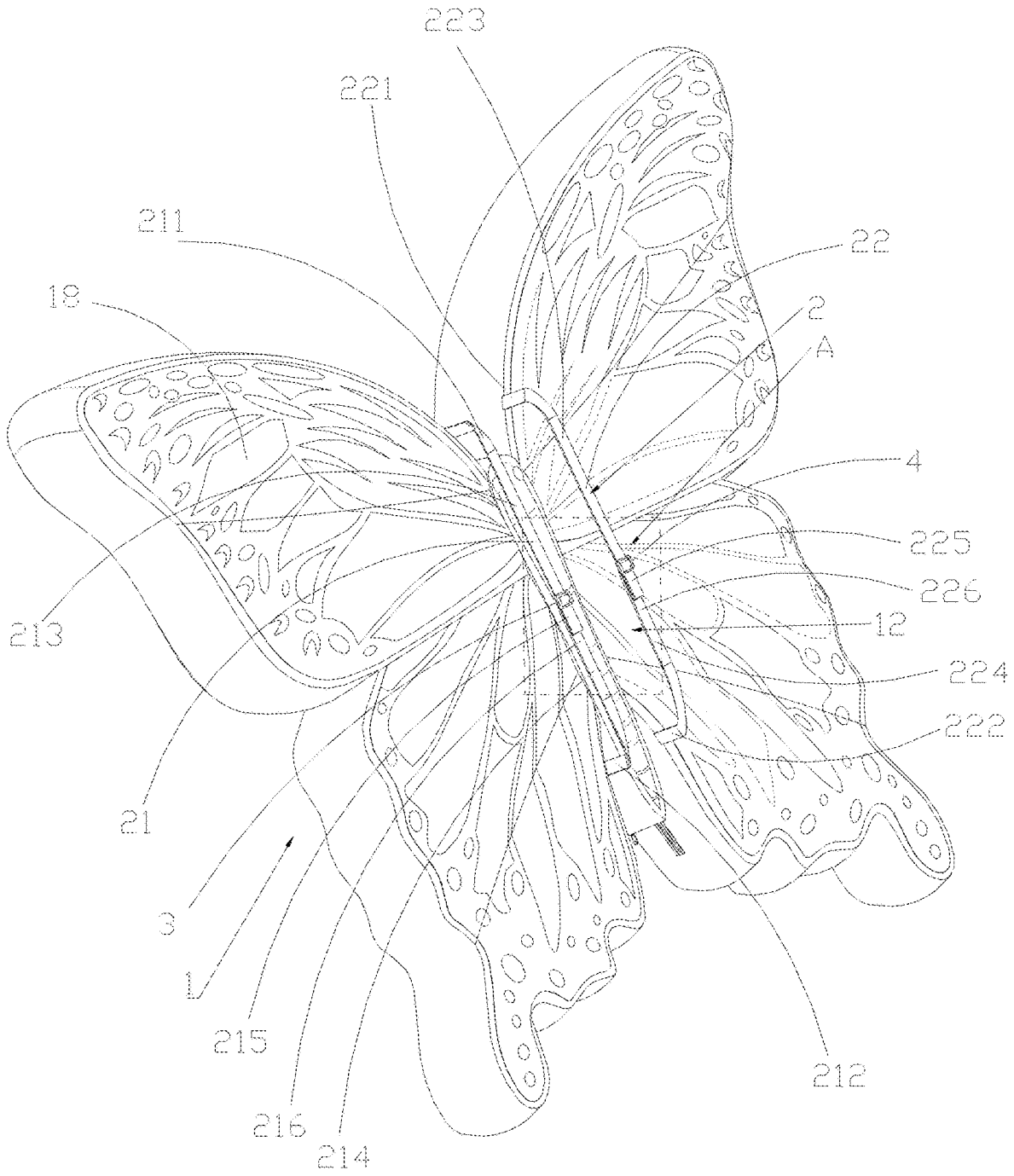
FIG. 1 is a schematic diagram of an entire structure of the present disclosure.
Figure 2:
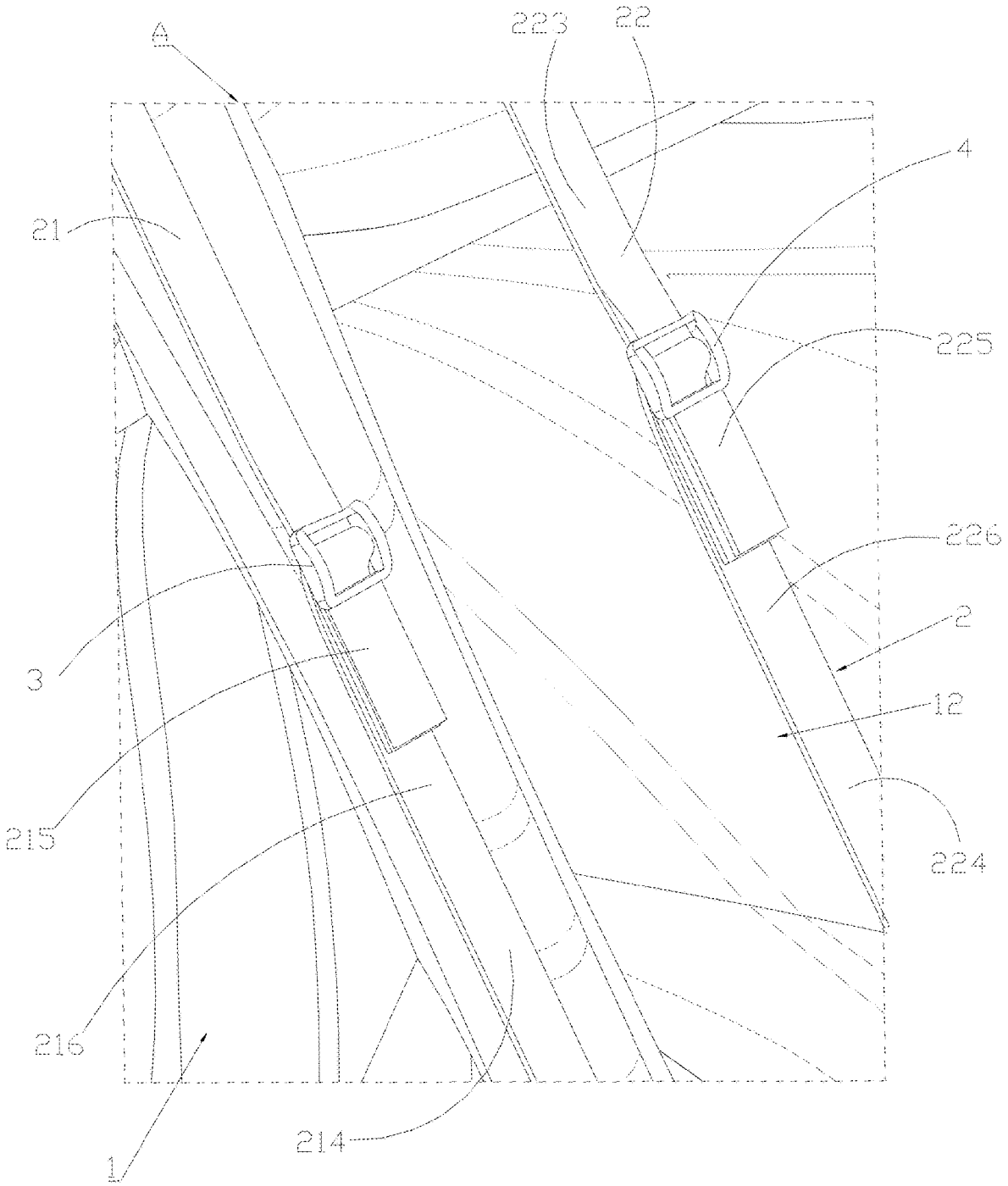
FIG. 2 is an enlarged view of the part A in FIG. 1.
Figure 3:
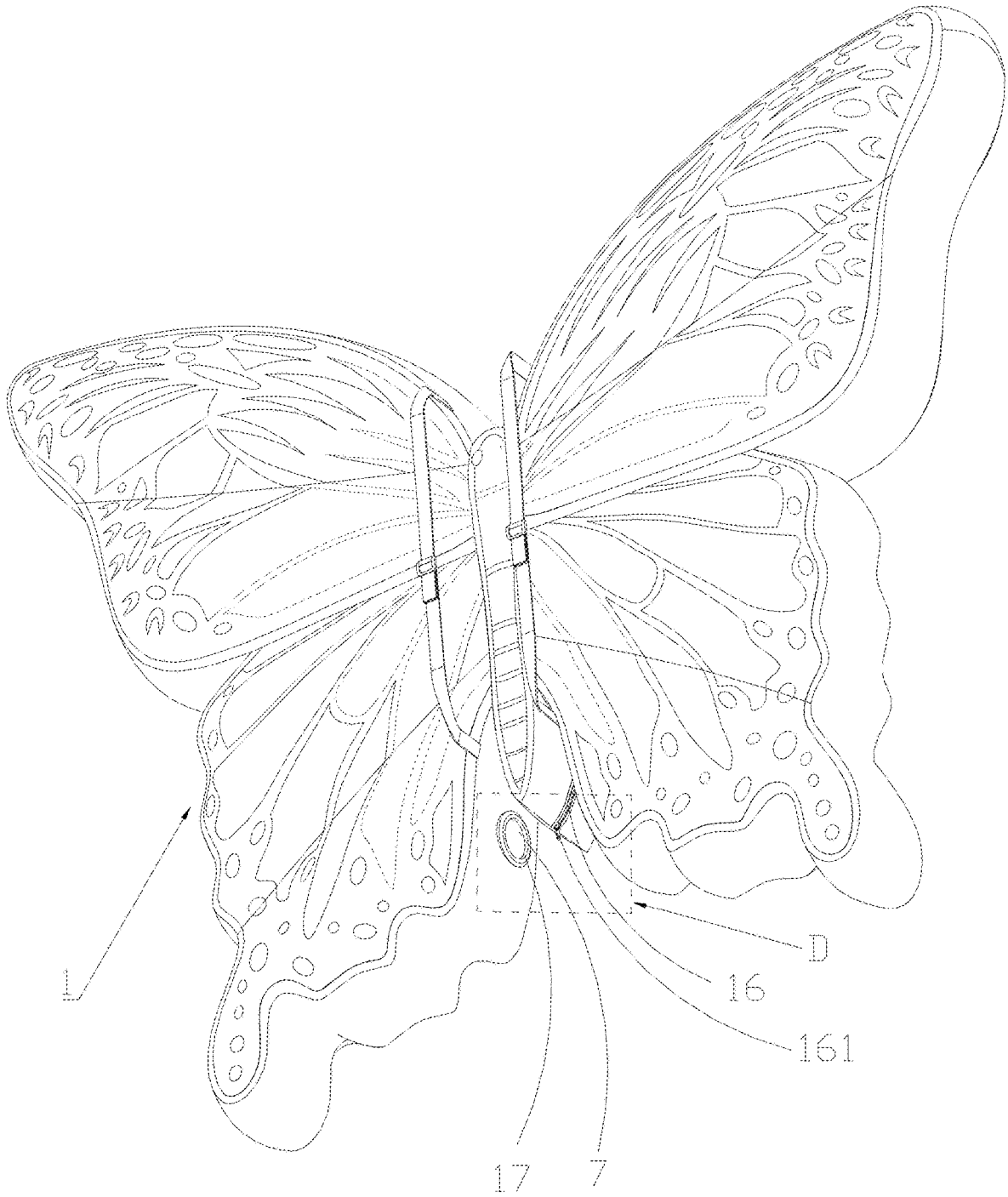
FIG. 3 is a schematic diagram of another entire structure of the present disclosure.
Figure 4:
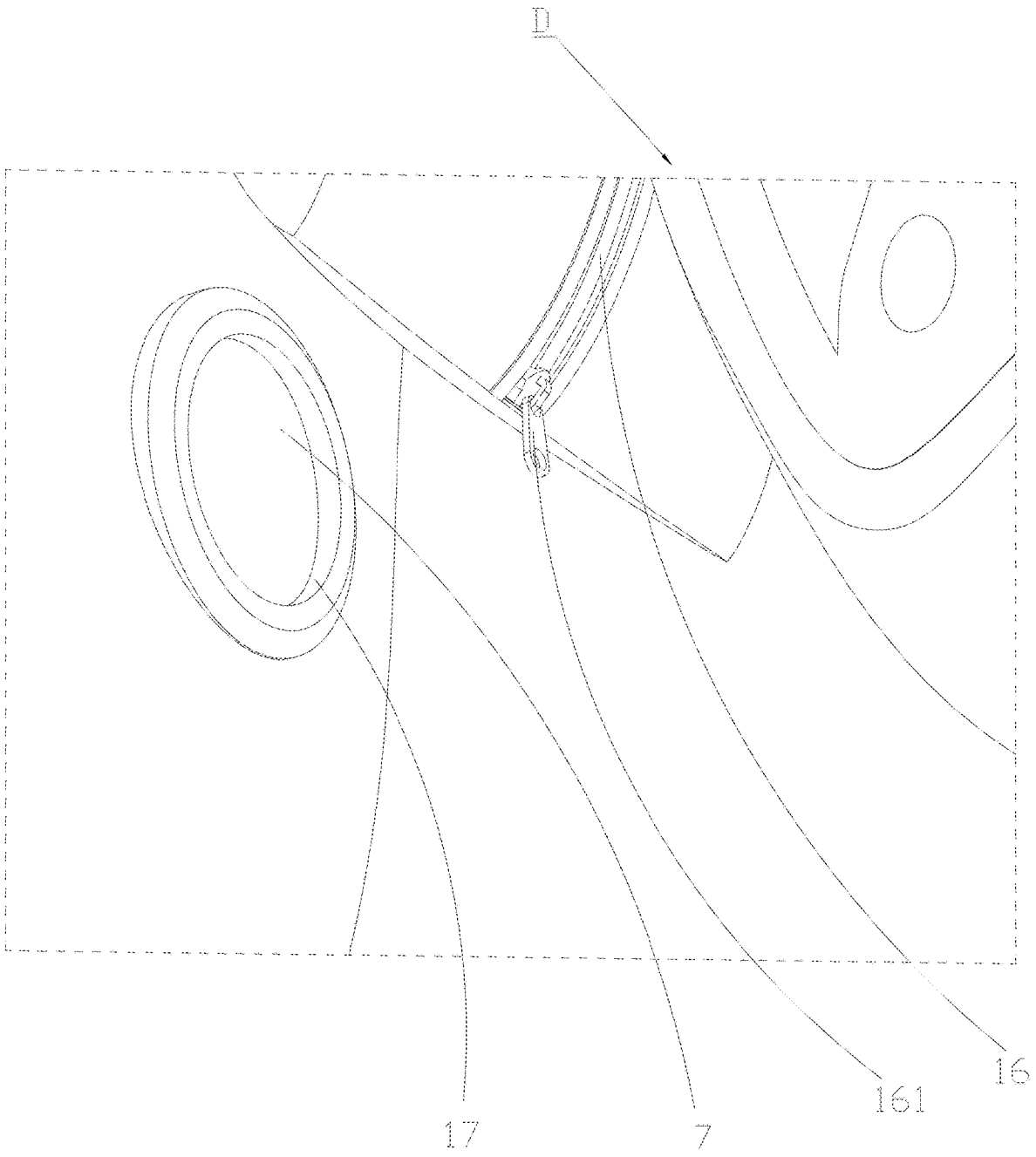
FIG. 4 is an enlarged view of the part D in FIG. 3.
Figure 5:
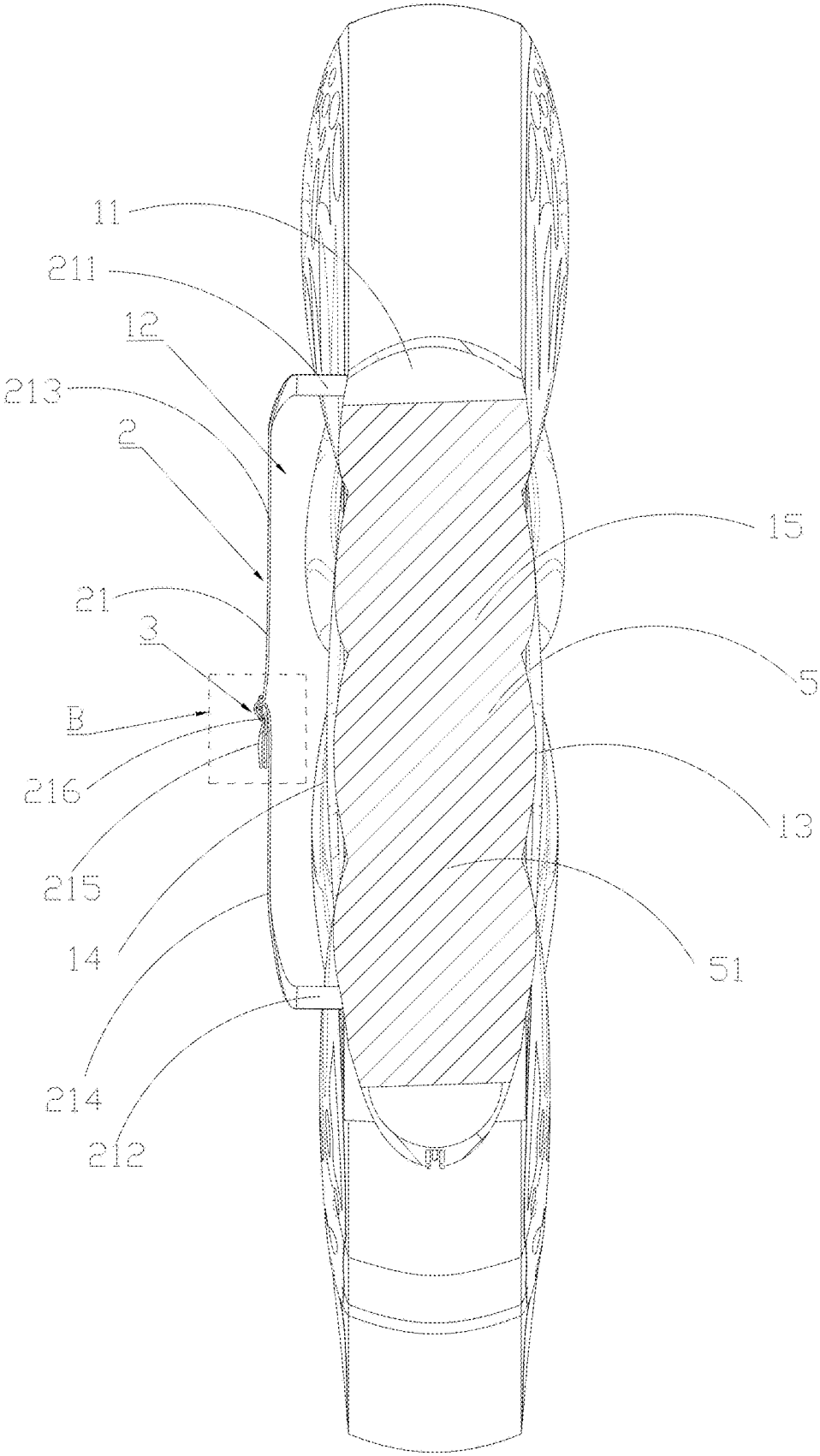
FIG. 5 is a sectional view cut away along a first strap, a first adjustment buckle, a shaping portion, and an inflatable costume main body.
Figure 6:
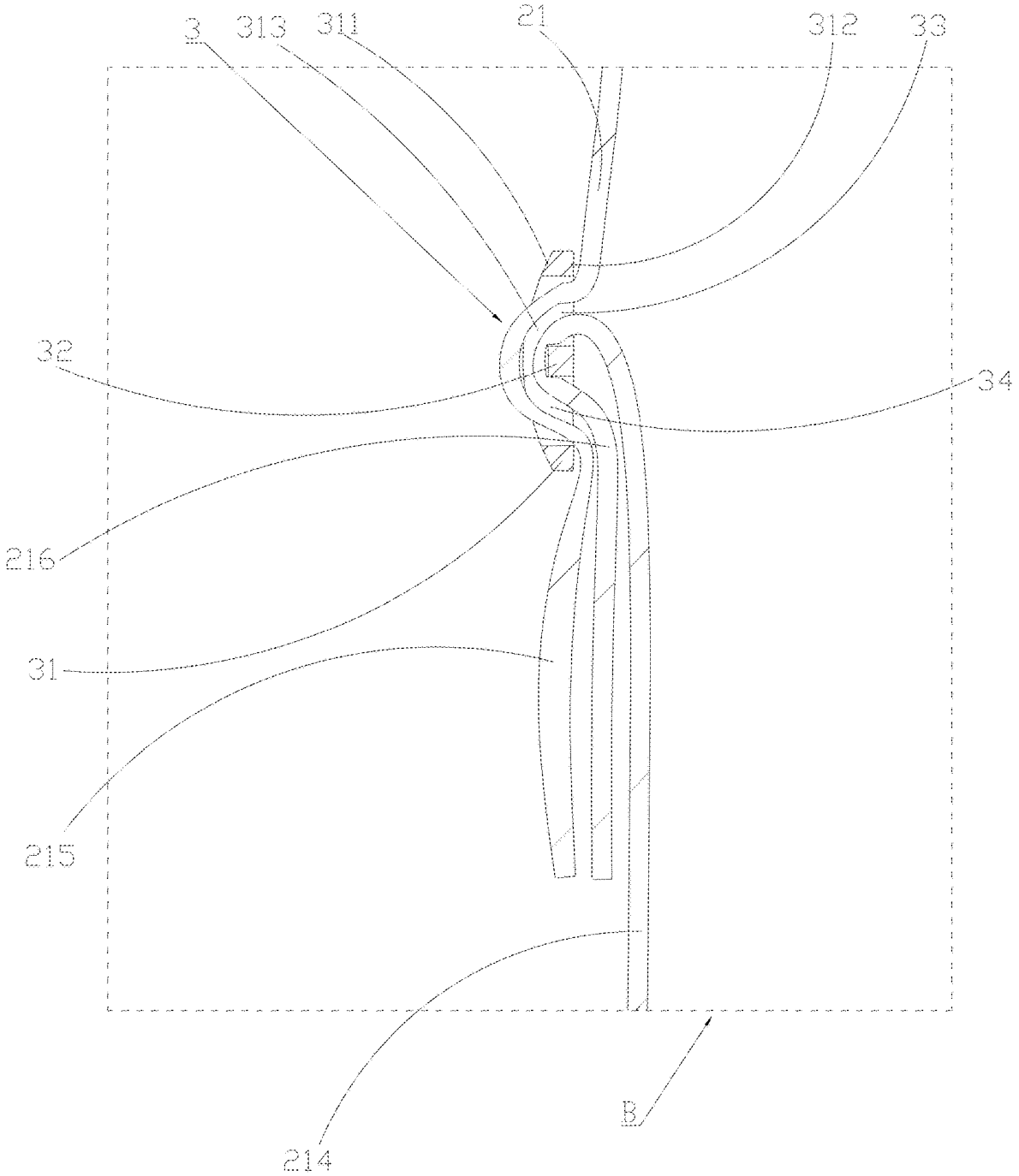
FIG. 6 is an enlarged view of the part B in FIG. 5.
Figure 7:
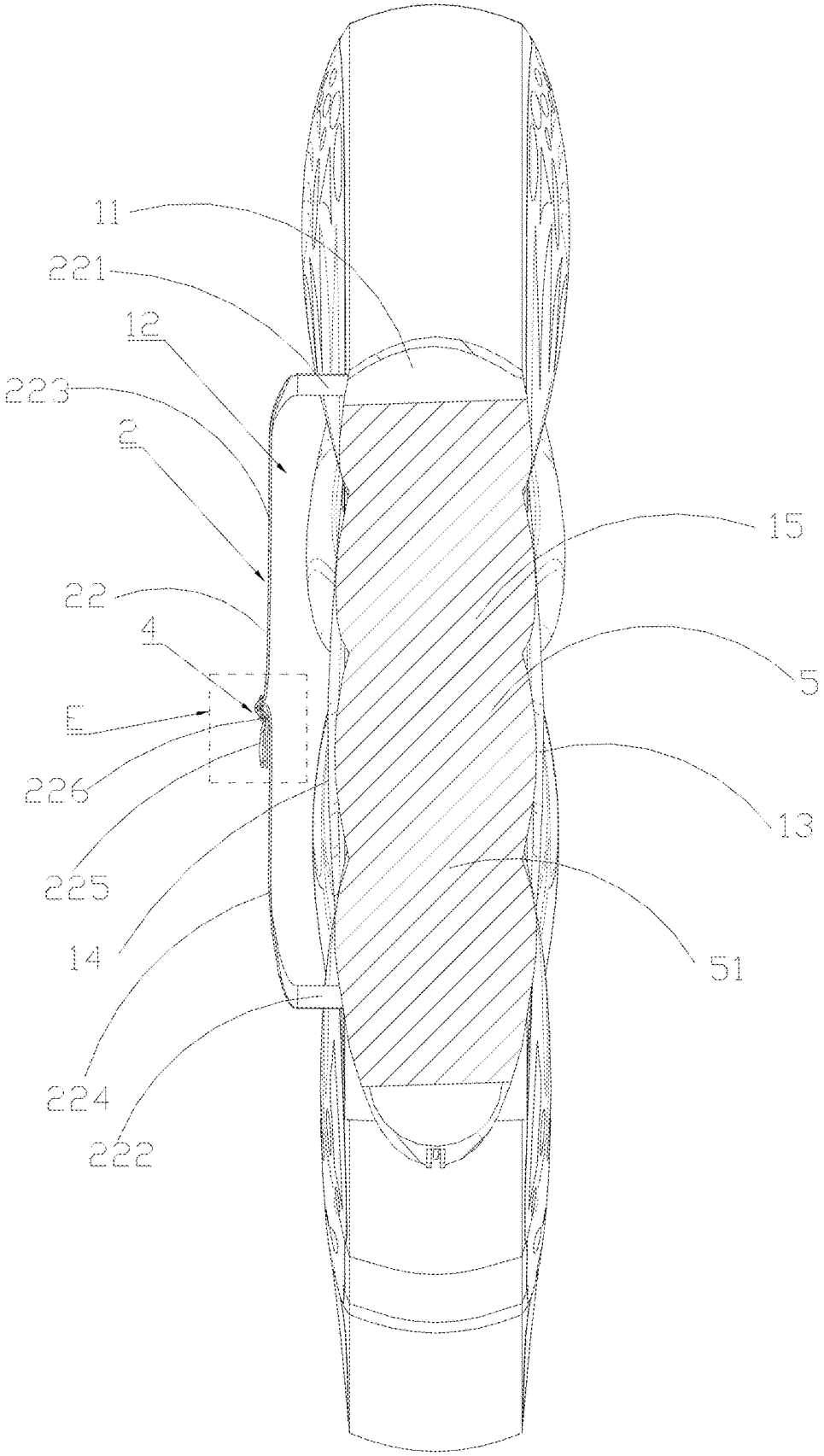
FIG. 7 is a sectional view cut away along a second strap, a second adjustment buckle, a shaping portion, and an inflatable costume main body.
Figure 8:
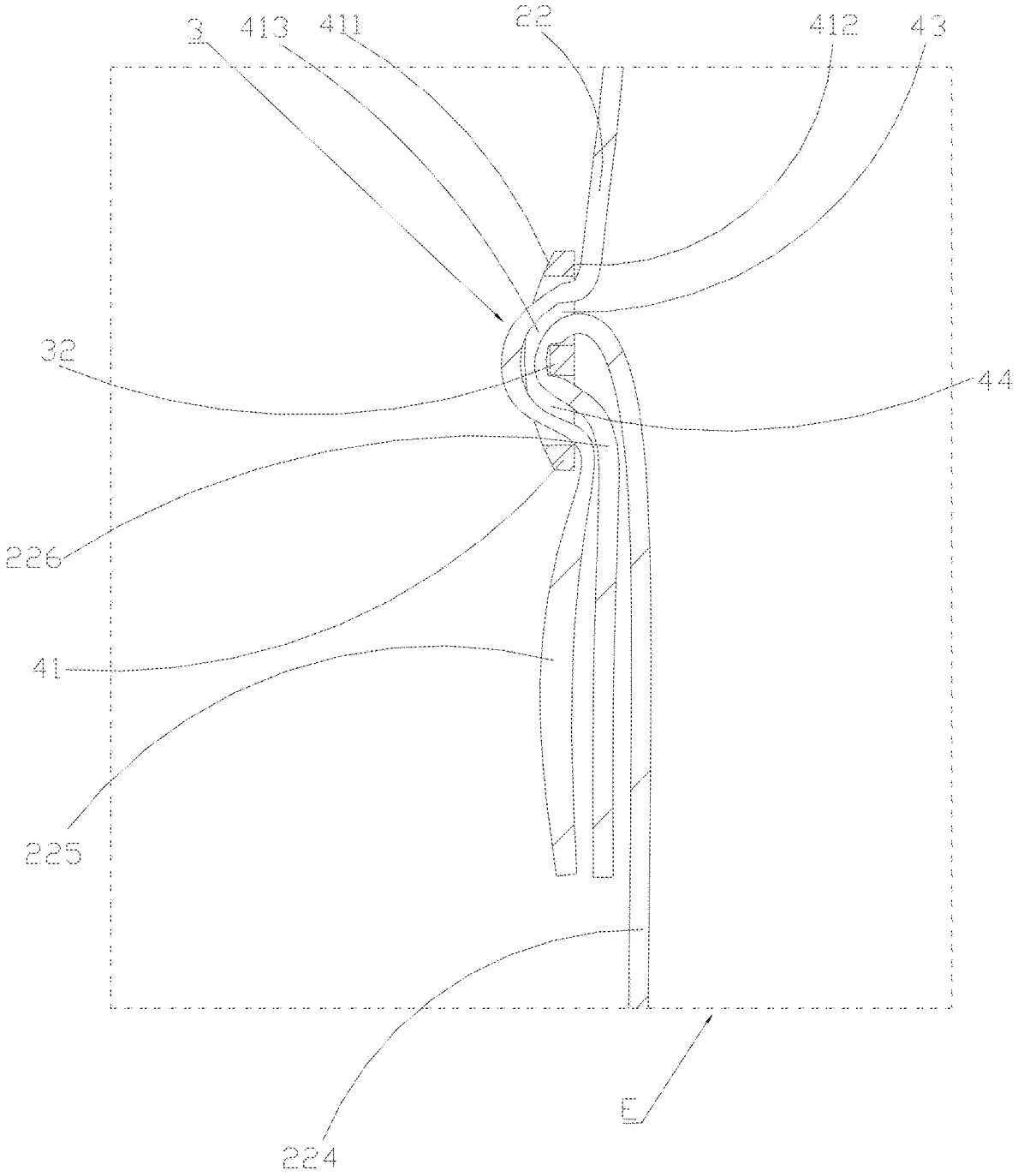
FIG. 8 is an enlarged view of the part E in FIG. 7.
Figure 9:
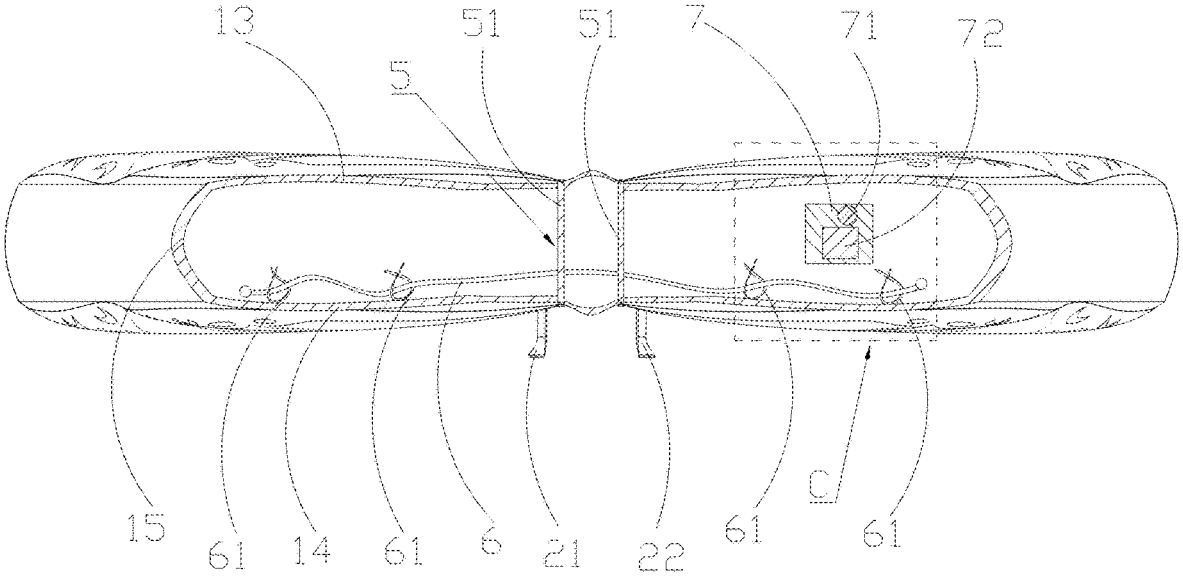
FIG. 9 is a sectional view cut away along a shaping portion.
Figure 10:
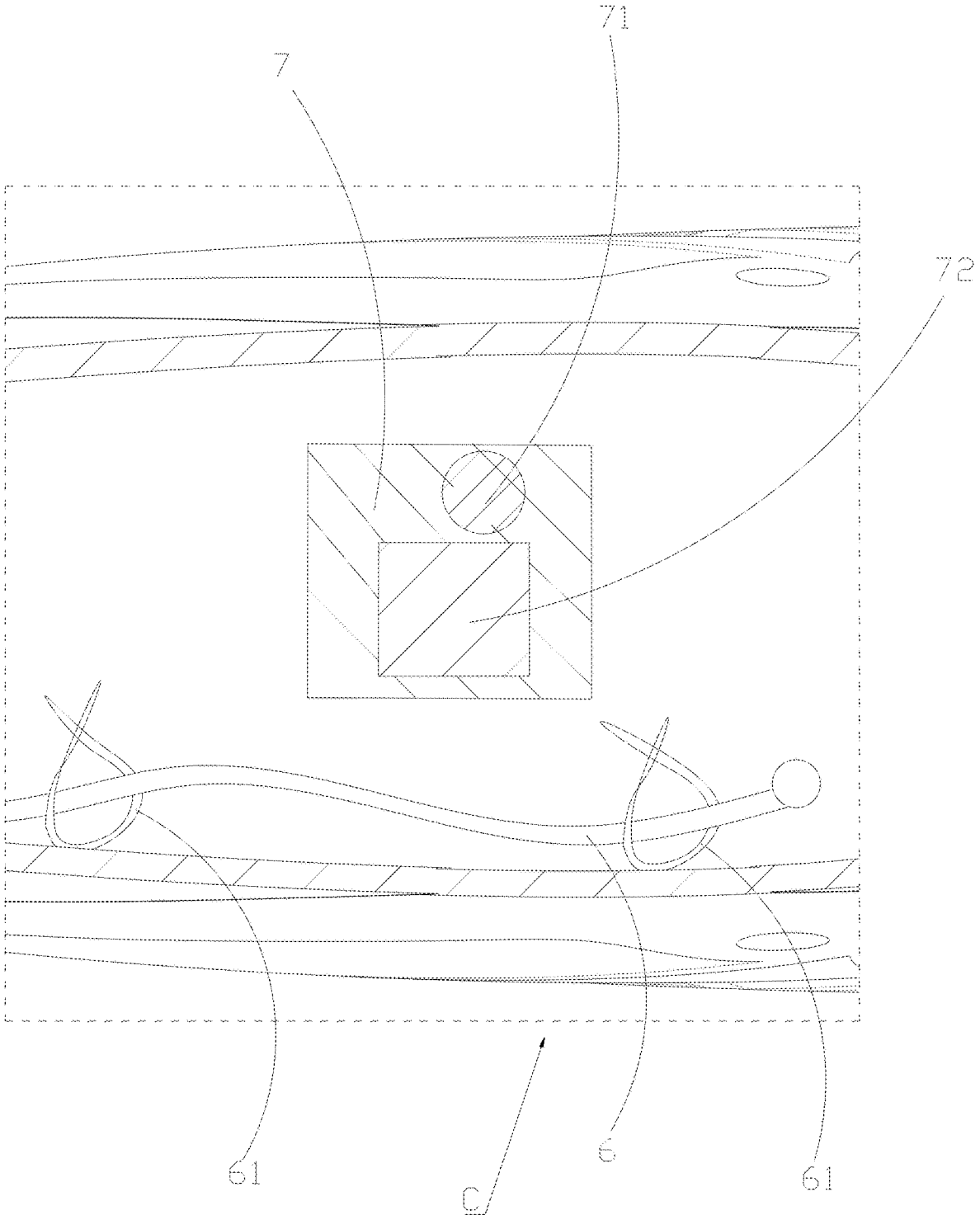
FIG. 10 is an enlarged view of the part C in FIG. 9.

Referring to FIG. 1 to FIG. 10, a wearable inflatable costume includes:

an inflatable costume main body 1, wherein the inflatable costume main body 1 is provided with a plurality of side walls and an inflation chamber 11, and the inflation chamber 11 is formed by encircling the plurality of side walls of the inflatable costume main body 1; and a strap assembly 2, wherein the strap assembly 2 is connected to the inflatable costume main body 1, and a wearing space 12 is formed by being surrounded between the strap assembly 2 and the inflatable costume main body 1.

Through the above structure, since the wearable inflatable costume includes: a inflatable costume main body 1, wherein the inflatable costume main body 1 is provided with a plurality of side walls and an inflation chamber 11, and the inflation chamber 11 is formed by encircling the plurality of side walls of the inflatable costume main body 1; and a strap assembly 2, wherein the strap assembly 2 is connected to the inflatable costume main body 1, and a wearing space 12 is formed by being surrounded between the strap assembly 2 and the inflatable costume main body 1. A user can wear the inflatable consume main body 1 through the wearing space 12 formed between the strap assembly 2 and the inflatable costume main body 1 and can carry the inflatable costume main body 1 on the shoulders. Compared with an ordinary inflatable costume that cannot be worn by a user only when the user enters the inflatable costume, the wearable inflatable costume is not sweltering and has high wearing comfort, and a user can wear the inflatable costume main body 1 for a long time.

In this embodiment, the strap assembly 2 includes a first strap 21; the first strap 21 has a first end 211 and a second end 212; the first end 211 of the first strap 21 is connected to an upper side of the inflatable costume main body 1; the second end 212 of the first strap 21 is connected to a lower side of the inflatable costume main body 1; and the wearing space 12 is formed between the first strap 21 and the inflatable costume main body 1. The wearable inflatable costume further includes a first adjustment buckle 3; the first adjustment buckle 3 is connected to the first strap 21; and the first adjustment buckle 3 is configured to adjust a length of the first strap 21 to adjust a size of the wearing space 12. Specifically, the strap assembly 2 further includes a second strap 22; the second strap 22 has a third end 221 and a fourth end 222; the third end 221 of the second strap 22 is connected to an upper side of the inflatable costume main body 1; the fourth end 222 of the first strap 22 is connected to a lower side of the inflatable costume main body 1; and the wearing space 12 is formed between the second strap 22 and the inflatable costume main body 1. Further, the wearable inflatable costume includes a second adjustment buckle 4; the second adjustment buckle 4 is connected to the second strap 22; and the second adjustment buckle 4 is configured to adjust a length of the second strap 22 to adjust a size of the wearing space 12. The first strap 21 includes a first strap unit 213 and a second strap unit 214; the first end 211 is arranged at the first strap unit 213; the second end 212 is arranged at the second strap unit 214; the first strap unit 213 further has a fifth end 215 opposite to the first end 211; the second strap unit 214 further has a sixth end 216 opposite to the second end 212; the first end 211 of the first strap unit 213 is connected to the upper side of the inflatable costume main body 1; the second end 212 of the second strap unit 214 is connected to the lower side of the inflatable costume main body 1; and the fifth end 215 of the first strap unit 213 is connected to the sixth end 216 of the second strap unit 214 through a first adjustment buckle 3. The first adjustment buckle 3 is provided with a first main body 31 and a first division portion 32; the first main body 31 has a first upper surface 311, a first lower surface 312, and a first opening 313; the first division portion 32 is connected to the first main body 31; the first division portion 32 is configured to divide the first opening 313 into a first adjustment hole 33 and a second adjustment hole 34; the sixth end 216 is connected to the first division portion 32; and the fifth end 215 penetrates into the first upper surface 311 through the first adjustment hole 33 on the first lower surface 312 of the first main body 31, and penetrates into the first lower surface 312 through the second adjustment hole 34 on the first upper surface 311, so that the fifth end 215 of the first strap unit 213 can slide through the first division portion 32 in the first adjustment hole 33 and the second adjustment hole 34 to adjust a distance between the first adjustment buckle 3 and the first end 211, so as to adjust the size of the wearing space 12. Still further, the second strap 22 includes a third strap unit 223 and a fourth strap unit 224; the third end 221 is arranged at the third strap unit 223; the fourth end 222 is arranged at the fourth strap unit 224; the third strap unit 223 further has a seventh end 225 opposite to the third end 221; the fourth strap unit 224 further has an eighth end 226 opposite to the fourth end 222; the third end 221 of the third strap unit 223 is connected to the upper side of the second inflatable costume main body 1; the fourth end 222 of the fourth strap unit 224 is connected to the lower side of the inflatable costume main body 1; and the seventh end 225 of the third strap unit 223 is connected to the eighth end 226 of the fourth strap unit 224 through a second adjustment buckle 4. Still further, the second adjustment buckle 4 is provided with a second main body 41 and a second division portion 42; the second main body 41 has a second upper surface 411, a second lower surface 412, and a second opening 413; the second division portion 42 is connected to the second main body 41; the second division portion 42 is configured to divide the second opening 413 into a third adjustment hole 43 and a fourth adjustment hole 44; the eighth end 226 is connected to the second division portion 42; and the seventh end 225 penetrates into the second upper surface 411 through the third adjustment hole 43 on the second lower surface 412 of the second main body 41, and penetrates into the second lower surface 412 through the fourth adjustment hole 44 on the second upper surface 411, so that the seventh end 225 of the third strap unit (223) can slide through the second division portion 42 in the third adjustment hole 43 and the fourth adjustment hole 44 to adjust a distance between the second adjustment buckle 4 and the third end 221, so as to adjust the size of the wearing space 12. Still further, the fifth end 215 of the first strap unit 213 is detachably connected to the sixth end 216 of the second strap unit 214 through the first adjustment buckle 3; and the seventh end 225 of the third strap unit 223 is detachably connected to the eighth end 226 of the fourth strap unit 224 through the second adjustment buckle 4. Through the above structure, since the first adjustment buckle 3 and the second adjustment buckle 4 are arranged to adjust the length of the first strap 21 and the length of the second strap 22, to adjust the size of the wearing space 12, the inflatable costume main body 1 can be adapted to people with different heights, thereby improving the generality of the inflatable costume main body 1. Furthermore, due to the arrangement of the first strap 21 and the second strap 22, a user can carry the inflatable costume main body 1 onto the shoulders. This further improves the comfort of wearing.

In this embodiment, the strap assembly 2 is an elastic strap assembly 2. Through the above structure, the elastic strap assembly 2 can adjust the length of the strap assembly 2 in an elastic range, making it convenient for a user to wear, and the elastic strap assembly 2 can improve the comfort of a user when the user wears the inflatable costume main body 1.

In this embodiment, the wearable inflatable costume further includes a shaping portion 5; two ends of the shaping portion 5 are separately connected to two side walls among the plurality of side walls; and the shaping portion 5 is configured to fix a spacing between the two side walls among the plurality of side walls. The inflatable costume main body 1 at least includes an upper side wall 13, a lower side wall 14, and a connecting side wall 15 for connecting the upper side wall 13 to the lower side wall 14; one end of the shaping portion 5 is connected to the upper side wall 13, and the other end of the shaping portion 5 is connected to the lower side wall 14; and the shaping portion 5 is configured to fix a spacing between the upper side wall 13 and the lower side wall 14. Specifically, the shaping portion 5 is arranged in the inflation chamber 11; one end of the shaping portion 5 is connected to an inner surface of the upper side wall 13; and the other end of the shaping portion 5 is connected to an inner surface of the lower side wall 14. Further, the shaping portion 5 includes a plurality of elongated shaping fabrics 51 spaced apart from each other. Through the above structure, due to the arrangement of the shaping portion 5 configured to fix the spacing between the upper side wall 13 and the lower side wall 14, the inflatable costume main body 1 in an inflated state can maintain the spacing between the upper side wall 13 and the lower side wall 14 connected to the shaping portion 5. However, a region with no shaping portion 5 will naturally expand in the inflated state, so that a shaped region and a non-shaped region have different shapes, and a depression is formed between the shaped region and the non-shaped region. By the arrangement and setting of a plurality of shaping fabrics 51, a specific shape can be made to achieve the shaping of the inflatable costume main body 1.

In this embodiment, the wearable inflatable costume further includes a light string 6; and the light string 6 is arranged in the inflation chamber 11. The wearable inflatable costume further includes a binding belt 61; the binding belt 61 is connected to the inflatable costume main body 1; the binding belt 61 is located in the inflation chamber 11; and the light string 6 is connected to the inflatable costume main body 1 through the binding belt 61. Through the above structure, the light emitted by the light string 6 arranged in the inflation chamber 11 can irradiate the inflatable costume main body 1 to decorate the inflatable costume main body 1 and make the inflatable costume main body 1 more beautiful. Moreover, fixing the light string 6 in the inflatable costume main body 1 by using the binding belt 61 can fix the position of the light string 6, so that the light emitted by the light string 6 can more uniformly irradiate all the corners of the inflatable costume main body 1. There are a plurality of binding belts 61. The plurality of binding belts 61 are arranged in a plurality of regions of the inflatable costume main body 1 at intervals.

In this embodiment, the wearable inflatable costume further includes a light string 6 and a binding belt 61; the binding belt 61 is connected to the inflatable costume main body 1; and the light string 6 is connected to the inflatable costume main body 1 through the binding belt 61. Through the above structure, the light emitted by the light string 6 arranged on the inflatable costume main body 1 can irradiate the inflatable costume main body 1 to decorate the inflatable costume main body 1 and make the inflatable costume main body 1 more beautiful. Moreover, fixing the light string 6 in the inflatable costume main body 1 by using the binding belt 61 can fix the position of the light string 6, so that the light emitted by the light string 6 can more uniformly irradiate all the corners of the inflatable costume main body 1. There are a plurality of binding belts 61. The plurality of binding belts 61 are arranged in a plurality of regions of the inflatable costume main body 1 at intervals.

In this embodiment, the inflatable costume main body 1 is a human-shaped or animal-shaped inflatable costume main body 1 or a plant-shaped inflatable costume main body 1. Specifically, the inflatable costume main body 1 is a butterfly-shaped inflatable costume main body 1. Through the above structure, due to the butterfly-shaped inflatable costume main body 1, when a user carries the inflatable costume main body 1 on the shoulders through the strap assembly 2, the overall image of the user becomes angelic, making the overall image of the user beautiful and dreamy.

In this embodiment, the inflatable costume main body 1 is a polyester fiber inflatable main body 1. Through the above structure, the polyester fiber inflatable costume main body 1 has good tear resistance, is not easily torn, and has a long service life, and it is convenient for a user to repeatedly wear the inflatable costume main body 1.

In this embodiment, the wearable inflatable costume further includes an air pump 7; the inflatable costume main body 1 is provided with a third opening 16 and an inflation port 17; the third opening 16 is communicated to the inflation chamber 11; a zipper 161 is arranged at the third opening 16; the zipper 161 is configured to open or close the third opening 16; the air pump 7 is arranged in the inflation chamber 11; and the air pump is arranged at the inflation port 17 to inflate the inflation chamber 11. The air pump 7 is provided with a switch 71 and a battery 72. The switch 71 is configured to switch on or switch off the air pump 7. Through the above structure, a user can open the third opening 16 through the zipper 161 and enter the inflation chamber 11 to switch on or switch off the air pump 7, so that the air pump can inflate the inflation chamber through the inflation port. Several decorative patterns 18 are further printed on an outer surface of the inflatable costume main body.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A wearable inflatable costume, comprising:

an inflatable costume main body, wherein the inflatable costume main body is provided with a plurality of side walls and an inflation chamber, and the inflation chamber is formed by encircling the plurality of side walls of the inflatable costume main body; and a strap assembly, wherein the strap assembly is connected to the inflatable costume main body, and a wearing space is formed by being surrounded between the strap assembly and the inflatable costume main body;

the wearable inflatable costume further comprising a shaping portion, wherein two ends of the shaping portion are separately connected to two side walls among the plurality of side walls; and the shaping portion is configured to fix a spacing between the two side walls among the plurality of side walls;

wherein the shaping portion comprises a plurality of elongated shaping fabrics spaced apart from each other.

2. The wearable inflatable costume according to claim 1, wherein the strap assembly comprises a first strap; the first strap has a first end and a second end; the first end of the first strap is connected to an upper side of the inflatable costume main body; the second end of the first strap is connected to a lower side of the inflatable costume main body; and the wearing space is formed between the first strap and the inflatable costume main body.

3. The wearable inflatable costume according to claim 2, further comprising a first adjustment buckle, wherein the first adjustment buckle is connected to the first strap; and the first adjustment buckle is configured to adjust a length of the first strap to adjust a size of the wearing space.

4. The wearable inflatable costume according to claim 3, wherein the strap assembly further comprises a second strap; the second strap has a third end and a fourth end; the third end of the second strap is connected to an upper side of the inflatable costume main body; the fourth end of the first strap is connected to a lower side of the inflatable costume main body; and the wearing space is formed between the second strap and the inflatable costume main body.

5. The wearable inflatable costume according to claim 4, further comprising a second adjustment buckle, wherein the second adjustment buckle is connected to the second strap; and the second adjustment buckle is configured to adjust a length of the second strap to adjust a size of the wearing space.

6. The wearable inflatable costume according to claim 1, wherein the strap assembly is an elastic strap assembly.

7. The wearable inflatable costume according to claim 1, wherein the inflatable costume main body at least comprises an upper side wall, a lower side wall, and a connecting side wall for connecting the upper side wall to the lower side wall; one end of the shaping portion is connected to the upper side wall, and the other end of the shaping portion is connected to the lower side wall; and the shaping portion is configured to fix a spacing between the upper side wall and the lower side wall.

8. The wearable inflatable costume according to claim 7, wherein the shaping portion is arranged in the inflation chamber; one end of the shaping portion is connected to an inner surface of the upper side wall; and the other end of the shaping portion is connected to an inner surface of the lower side wall.

9. The wearable inflatable costume according to claim 1, further comprising a light string, wherein the light string is arranged in the inflation chamber.

10. A wearable inflatable costume, comprising:

an inflatable costume main body, wherein the inflatable costume main body is provided with a plurality of side walls and an inflation chamber, and the inflation chamber is formed by encircling the plurality of side walls of the inflatable costume main body; and a strap assembly, wherein the strap assembly is connected to the inflatable costume main body, and a wearing space is formed by being surrounded between the strap assembly and the inflatable costume main body;

the wearable inflatable costume further comprising a light string, wherein the light string is arranged in the inflation chamber;

the wearable inflatable costume further comprising a binding belt, wherein the binding belt is connected to the inflatable costume main body; the binding belt is located in the inflation chamber; and the light string is connected to the inflatable costume main body through the binding belt.

11. A wearable inflatable costume, comprising:

an inflatable costume main body, wherein the inflatable costume main body is provided with a plurality of side walls and an inflation chamber, and the inflation chamber is formed by encircling the plurality of side walls of the inflatable costume main body; and a strap assembly, wherein the strap assembly is connected to the inflatable costume main body, and a wearing space is formed by being surrounded between the strap assembly and the inflatable costume main body;

the wearable inflatable costume further comprising a light string and a binding belt, wherein the binding belt is connected to the inflatable costume main body; and the light string is connected to the inflatable costume main body through the binding belt.

12. The wearable inflatable costume according to claim 5, wherein the first strap comprises a first strap unit and a second strap unit; the first end is arranged at the first strap unit; the second end is arranged at the second strap unit; the first strap unit further has a fifth end opposite to the first end; the second strap unit further has a sixth end opposite to the second end; the first end of the first strap unit is connected to the upper side of the inflatable costume main body; the second end of the second strap unit is connected to the lower side of the inflatable costume main body; and the fifth end of the first strap unit is connected to the sixth end of the second strap unit through a first adjustment buckle.

13. The wearable inflatable costume according to claim 12, wherein the first adjustment buckle is provided with a first main body and a first division portion; the first main body has a first upper surface, a first lower surface, and a first opening; the first division portion is connected to the first main body; the first division portion is configured to divide the first opening into a first adjustment hole and a second adjustment hole; the sixth end is connected to the first division portion; and the fifth end penetrates into the first upper surface through the first adjustment hole on the first lower surface of the first main body, and penetrates into the first lower surface through the second adjustment hole on the first upper surface, so that the fifth end of the first strap unit slides through the first division portion in the first adjustment hole and the second adjustment hole to adjust a distance between the first adjustment buckle and the first end, so as to adjust the size of the wearing space.

14. The wearable inflatable costume according to claim 12, wherein the second strap comprises a third strap unit and a fourth strap unit; the third end is arranged at the third strap unit; the fourth end is arranged at the fourth strap unit; the third strap unit further has a seventh end opposite to the third end; the fourth strap unit further has an eighth end opposite to the fourth end; the third end of the third strap unit is connected to the upper side of the second inflatable costume main body; the fourth end of the fourth strap unit is connected to the lower side of the inflatable costume main body; and the seventh end of the third strap unit is connected to the eighth end of the fourth strap unit through a second adjustment buckle.

15. The wearable inflatable costume according to claim 14, wherein the second adjustment buckle is provided with a second main body and a second division portion; the second main body has a second upper surface, a second lower surface, and a second opening; the second division portion is connected to the second main body; the second division portion is configured to divide the second opening into a third adjustment hole and a fourth adjustment hole; the eighth end is connected to the second division portion; and the seventh end penetrates into the second upper surface through the third adjustment hole on the second lower surface of the second main body, and penetrates into the second lower surface through the fourth adjustment hole on the second upper surface, so that the seventh end of the third strap unit slides through the second division portion in the third adjustment hole and the fourth adjustment hole to adjust a distance between the second adjustment buckle and the third end, so as to adjust the size of the wearing space.

16. The wearable inflatable costume according to claim 14, wherein the fifth end of the first strap unit is detachably connected to the sixth end of the second strap unit through the first adjustment buckle; and the seventh end of the third strap unit is detachably connected to the eighth end of the fourth strap unit through the second adjustment buckle.

17. The wearable inflatable costume according to claim 1, wherein the inflatable costume main body is a human-shaped or animal-shaped inflatable costume main body or a plant-shaped inflatable costume main body.

18. The wearable inflatable costume according to claim 1, wherein the inflatable costume main body is a polyester fiber inflatable costume main body.

* * * * *